US006092598A

United States Patent [19]

Breit

[11] Patent Number: 6,092,598

[45] Date of Patent: Jul. 25, 2000

[54] METHOD AND APPARATUS FOR MEASURING OPERATING PARAMETERS OF A SUBMERGIBLE PUMPING SYSTEM

[75] Inventor: Stephen M. Breit, Bartlesville, Okla.

[73] Assignee: Camco International, Inc., Houston, Tex.

[21] Appl. No.: 09/135,258

[22] Filed: Aug. 17, 1998

[51] Int. Cl.[7] ..... E21B 47/00

[52] U.S. Cl. ..... 166/250.01; 166/62; 166/66

[58] Field of Search ..... 166/250.01, 252.1, 166/62, 369, 370, 53, 66, 66.4

[56] References Cited

U.S. PATENT DOCUMENTS

| | | | |
|---|---|---|---|
| 2,745,497 | 5/1956 | Dale et al. | 166/224 |
| 3,486,380 | 12/1969 | Culver | 73/398 |
| 4,009,756 | 3/1977 | Zehren | 166/250 |
| 4,316,386 | 2/1982 | Kerekes | 73/151 |
| 4,638,198 | 1/1987 | Cochran | 310/871 |
| 5,213,159 | 5/1993 | Schneider | 166/250 |
| 6,006,837 | 12/1999 | Breit | 166/302 |

OTHER PUBLICATIONS

Mario J. Ciminelli, "A Modular Pressure Transducer," Jul. 1997 Sensors, pp. 34–36.

Jim Bilskie, "Using Dielectric Properties to Measure Soil Water Content," Jul. 1997 Sensors, pp. 26, 28, 30–32.

"Fiber Optic Rotary Joint, Model 190," Focal Technologies, Aug. 1996, Canada.

"Fiber Optic Rotary Joint, Model 197," Focal Technologies, Aug. 1996, Canada.

"Electrical Slip Ring, Model 180," Focal Technologies, Jan. 1997, Canada.

"The ERH Series Humidity Sensor," Jul. 1997, Sensor, p. 39.

*Primary Examiner*—Frank Tsay

*Attorney, Agent, or Firm*—Fletcher, Yoder & Van Someren

[57] ABSTRACT

A sensor assembly is used with a submergible pumping system within a wellbore. The sensor assembly is an integral part of the string of submergible components that form the submergible pumping system. One embodiment of the sensor assembly utilizes a sensor for detecting the axial downthrust load acting on the shaft of a submergible pump. The downthrust load can be used to determine, for instance, flow rate through the submergible pump.

22 Claims, 6 Drawing Sheets

METHOD AND APPARATUS FOR MEASURING OPERATING PARAMETERS OF A SUBMERGIBLE PUMPING SYSTEM

FIELD OF THE INVENTION

The present invention relates generally to a device for measuring operating parameters of a submergible pumping system in petroleum production wells, and more particularly, to a novel technique for producing signals indicative of parameters, such as pump flow rate, pump RPMs, vibration measurements and fluid properties in a submergible pumping system.

BACKGROUND OF THE INVENTION

Submergible pumping systems are widely used in the pumping of fluids, such as petroleum, from production wells. The typical submergible pumping system includes a variety of components assembled in a string for insertion into a wellbore, and ultimately into the fluid to be pumped to the earth's surface.

Numerous submergible components can be used in the submergible pumping system, but each system typically includes at least a submergible pump, a submergible motor to drive the pump, and a motor protector disposed somewhere between the submergible motor and the submergible pump. The string of components is deployed in a wellbore by, for instance, tubing, cable or coiled tubing. The production fluid, e.g., petroleum, is pumped to the surface of the earth either through tubing or through the annulus formed between the deployment system and an outer wellbore casing of the wellbore.

Regardless of the particular submergible pumping system used in a given application, it often becomes necessary to measure various parameters of the system. The measurements are particularly helpful if they can be performed during use of the submergible pumping system in the downhole environment of the wellbore. For example, it may be advantageous to measure parameters such as pump flow rate, pump speed, fluid temperature, fluid density, intake pressure as well as the oil dielectric in the motor protector. Present systems for measuring downhole parameters utilize separate units to measure, for instance, flow rate of the submergible pump. These separate units are typically expensive, add-on, stand-alone units that require special adaptation to the submergible pumping system for downhole operation. Often, such systems require extensive cable or valve arrangements to operate correctly.

It would be advantageous to have a simple sensor system that could be integrated into the string of submergible components for measuring submergible pump flow rates, and potentially other parameters of the submergible pumping system.

SUMMARY OF THE INVENTION

The present invention features a device for measuring an operating parameter related to a submergible pumping system in a downhole, wellbore environment. The device or system includes a first submergible component having a rotatable shaft and a second submergible component having a rotable shaft. A coupling assembly is connected between the rotatable shafts of the two submergible components such that the coupling assembly transfers rotation from the first rotatable shaft to the second rotatable shaft. The system further includes a sensor assembly positioned along the coupling assembly. The sensor assembly includes a sensor that is able to detect axial loading of the first rotatable shaft and to provide an output signal corresponding to this axial loading.

According to a another aspect of the invention, a submergible pumping system having an integral sensor assembly is provided for use in pumping production fluids from a wellbore. The system comprises a plurality of submergible pumping system components, including a submergible motor, a motor protector and a submergible pump. A sensor assembly is affixed intermediate two components of the plurality of the submergible pumping system components. The sensor assembly includes a sensor adapted to detect variation in a parameter internal to at least one of the plurality of submergible pumping system components.

According to another aspect of the present invention, a method is provided for sensing a given parameter within a submergible component of a submergible pumping system of the type utilized in pumping production fluids from a wellbore. The method includes assembling a string of submergible components, including a submergible motor and a submergible pump. The method also includes the step of locating an integral sensor assembly between a first submergible component and a second submergible component of the string of submergible components. The sensor assembly is utilized in detecting a predetermined parameter related to at least one of the string of submergible components. Additionally, an output signal, indicative of the predetermined parameter, is provided to a data receiving station.

BRIEF DESCRIPTION OF THE DRAWINGS

The invention will hereafter be described with reference to the accompanying drawings, wherein like reference numerals denote like elements, and.

DETAILED DESCRIPTION OF THE PREFERRED EMBODIMENT

Figure 1:
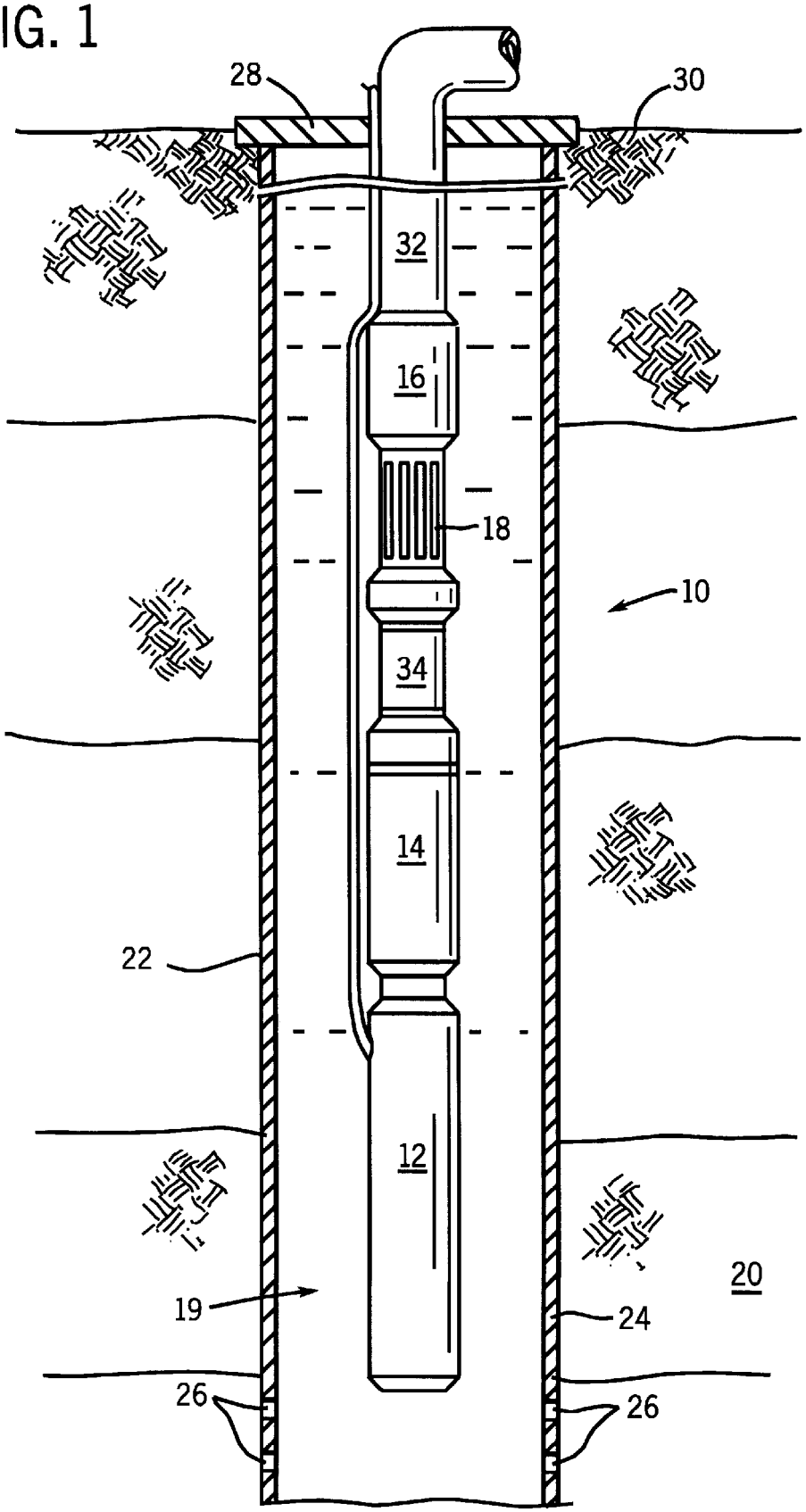
FIG. 1 is a front elevational view of a submergible pumping system positioned in a wellbore, according to a preferred embodiment of the present invention.

Referring generally to FIG. 1, a submergible pumping system 10 is illustrated according to a preferred embodiment of the present invention. Submergible pumping system 10 may comprise a variety of submergible components depending on the particular application or environment in which it is used. However, system 10 typically includes at least a submergible motor 12, a motor protector 14, and a submergible pump 16, such as a centrifugal pump. Submergible pump 16 may also include a gas separator 18 used to separate any gases from the production fluid as it is pumped.

As illustrated, system 10 is designed for deployment in a well 19 within a geological formation 20 containing desirable production fluids, such as petroleum. In a typical application, a wellbore 22 is drilled and lined with a wellbore casing 24. A plurality of openings or gaps 26 are formed through wellbore casing 24 to permit fluids to flow from formation 20 into wellbore 22 so that submergible pumping system 10 may pump the production fluids to a well head 28 at or above a surface 30 of the earth.

Submergible pumping system 10 is deployed within wellbore 22 by a deployment system 32. Deployment system 32 may comprise tubing, cable, or coil tubing. Depending on the specific type of system used, the production fluids are pumped to the surface either through the tubing or through the annulus formed between deployment system 32 and wellbore casing 24. If the production fluid is pumped to the surface utilizing the annulus, a packer, or some other type of sealing assembly, must be incorporated into the system to form a seal between the submergible pumping system and the inside wall of wellbore casing 24.

Regardless of the specific type of submergible pumping system, it often is desirable to measure downhole parameters related to the operation of submergible pumping system 10. The present inventive system incorporates a parameter measuring system 34 directly into the string of submergible components. By making parameter measuring system 34 an integral part of the string of submergible components, the sensor system can be installed easily at the time overall submergible pumping system 10 is assembled for installation in the well. Also, the present design of parameter measuring system 34 allows various parameters to be sensed or detected without requiring extra valves or gauges for operation.

Figure 2:
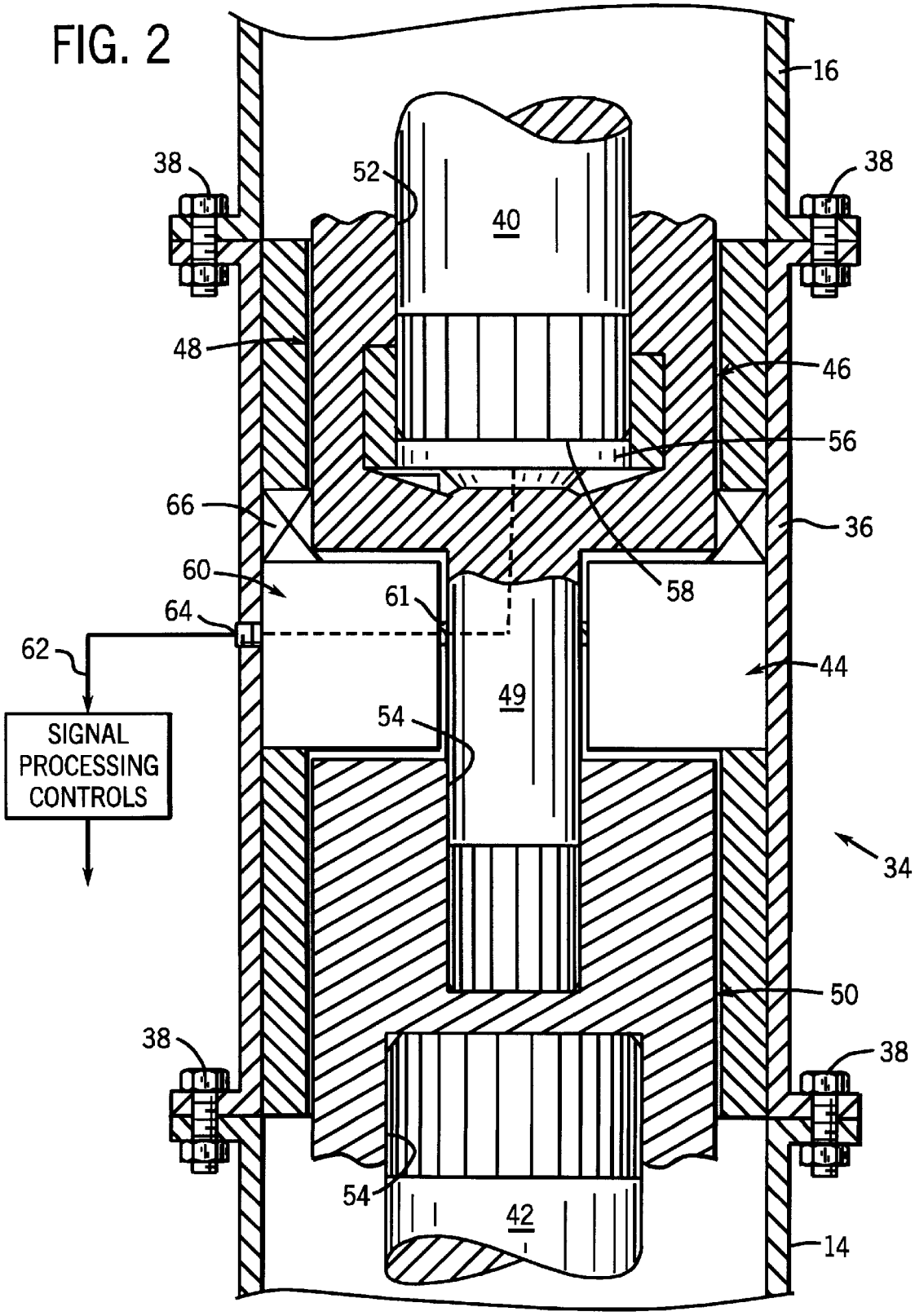
FIG. 2 illustrates a sensor assembly, according to a preferred embodiment of the present invention, positioned between components of the submergible pumping system.

In the preferred embodiment, parameter measuring system 34, as further illustrated in FIG. 2, includes an outer housing segment 36, preferably mounted between two submergible components of submergible pumping system 10. For example, outer housing segment 36 may be attached between submergible pump 16 and motor protector 14 by appropriate fasteners 38, such as bolts, as is conventionally done when connecting various submergible components.

Alternatively, the outer housing for parameter measuring system 34 can simply be the mounting structures at the connected ends of adjacent submergible components, e.g., submergible pump 16 and motor protector 14. Additionally, system 34 may be integrally located within the string of submergible components between other pairs of submergible components, depending on the specific application and the specific parameter or parameters being monitored. For the purpose of description, however, system 34 will be described as integrally positioned within the string of submergible components between submergible pump 16 and motor protector 14.

A beneficial aspect of the inventive parameter measuring system 34 is that it can be utilized to measure the downthrust of submergible pump 16 as it is running. This downthrust can be correlated to the pump curve and the actual flow of the unit can be determined. By locating system 34 between submergible pump 16 and motor protector 14, system 34 can detect immediately any loss or change in pump performance, as well as predicting excessive downthrust which could be an indication of impending pump failure. Furthermore, system 34 potentially can be used at this location and other locations in the string of submergible components to detect component wear or other unusual conditions.

In the preferred embodiment, parameter measuring system 34 is connected between sequential rotatable shafts of two adjacent submergible components. As illustrated, system 34 may be connected between an internal pump shaft 40 of submergible pump 16 and an internal rotatable shaft 42 of motor protector 14. By way of explanation, the submergible components in a submergible pumping system are connected by cooperating, sequential, rotatable shafts that are powered by submergible motor 12.

In the preferred embodiment, parameter measuring system 34 comprises a sensor assembly 44 and a coupling assembly 46 that couples the shaft of one submergible component to the next adjacent submergible component, e.g., the pump shaft 40 to shaft 42 of motor protector 14. In the embodiment illustrated in FIG. 2, the downthrust exerted on pump shaft 40 is measured. As discussed above, this downthrust typically results from the speed and volume of fluid being pumped, i.e., the flow rate, by submergible pump 16. Thus, the downthrust can be correlated to the pump curve and the actual flow rate of the submergible pump 16 can be determined.

In this embodiment, coupling assembly 46 includes a coupling measurement unit 48 mounted to the end of pump shaft 40 such that it is fixed to rotate with pump shaft 40 without being restricted in the axial direction relative to pump shaft 40. Coupling assembly 46 further includes a shaft portion 49 extending from coupling measurement unit 48 to a lower coupling unit 50. Lower coupling unit 50 is connected to motor protector shaft 42 to permit transfer of rotation to pump shaft 40. In the preferred embodiment, coupling measurement unit 48 includes an opening 52 for receiving pump shaft 40, and lower coupling unit 50 includes an opening 54 for receiving shaft 42. Pump shaft 40, motor protector shaft 42, and openings 52, 54 may have, for example, mating splined regions to prevent any relative rotational movement between those components.

In the embodiment illustrated, sensor assembly 44 includes a sensor 56, such as a pressure transducer, positioned between an end 58 of pump shaft 40 and coupling measurement unit 48. (Sensor 56 also could be positioned between shaft 42 and lower coupling unit 50.) Thus, as downthrust acting on pump shaft 40 increases or decreases, that variation is detected by sensor 56. Sensor 56 provides an output signal corresponding to the degree of downthrust. The output signal is transferred to a sensor pickup and lead assembly 60 of the sensor assembly 44. Preferably, sensor pickup assembly 60 is mounted stationary within outer housing segment 36 and the signal from sensor 56 is transferred through coupling shaft 49 or through a lead disposed along coupling shaft 49 to sensor pickup assembly 60. Transfer of the signal from rotating coupling assembly 46 to the stationary sensor pickup assembly 60 can be accomplished via appropriate contacts 61, such as ring contacts, electrical slip rings, a fluid rotary union or a fiber optic rotary joint. The signal is then transferred via a lead 62 through an appropriately sealed opening 64 formed through outer housing segment 36.

In the illustrated embodiment, coupling measurement unit 48 is substantially prevented from moving axially by, for instance, an appropriate thrust bearing 66 disposed adjacent sensor pickup assembly 60. This permits sensor 56, e.g., a pressure transducer, to measure the downthrust exerted by pump shaft 40 towards coupling measurement unit 48. Alternatively, coupling assembly 46 could be allowed to move axially under the influence of the downthrust load acting on pump shaft 40. This axial movement could be measured by stationary sensor pickup assembly 60 via an appropriate sensor, such as a modular pressure transducer or an optical grating type sensor.

Figure 2A:
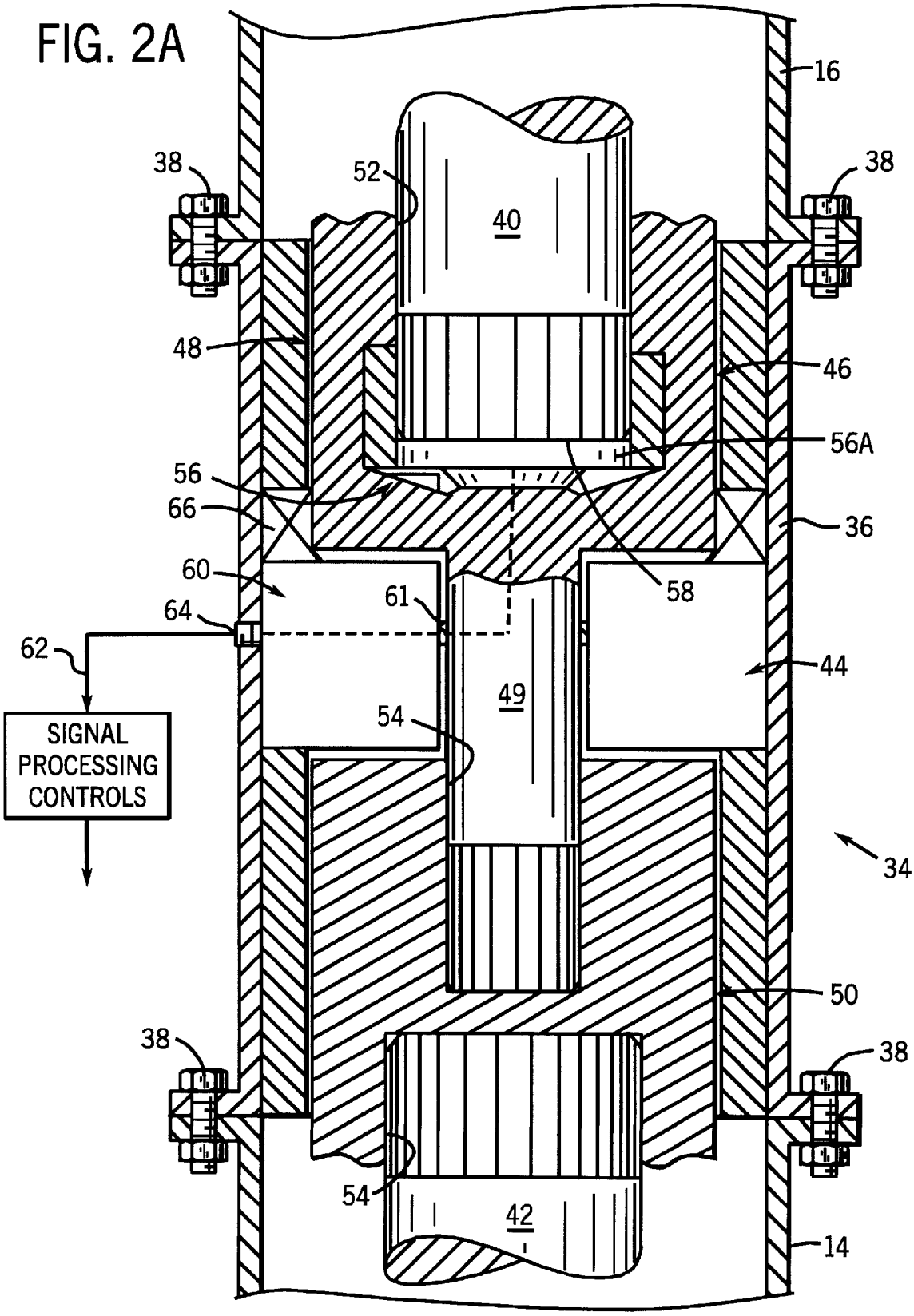
FIG. 2A illustrates a sensor assembly, according to an alternate embodiment of the present invention, positioned between components of the submergible pumping system.

For example, in the design illustrated in FIG. 2A, sensor 56 comprises a modular pressure transducer 56A that measures downthrust by sensing movement of pump shaft 40. With this design, thrust bearing 66 is eliminated, and sensor pickup assembly 60 is held in place along the outer housing segment 36. The signal generated by the modular pressure transducer 56A preferably is communicated to sensor pickup assembly 60 by contacts 61, e.g., electrical slip rings, a rotary union or a fiber optical union joint.

Figure 2B:
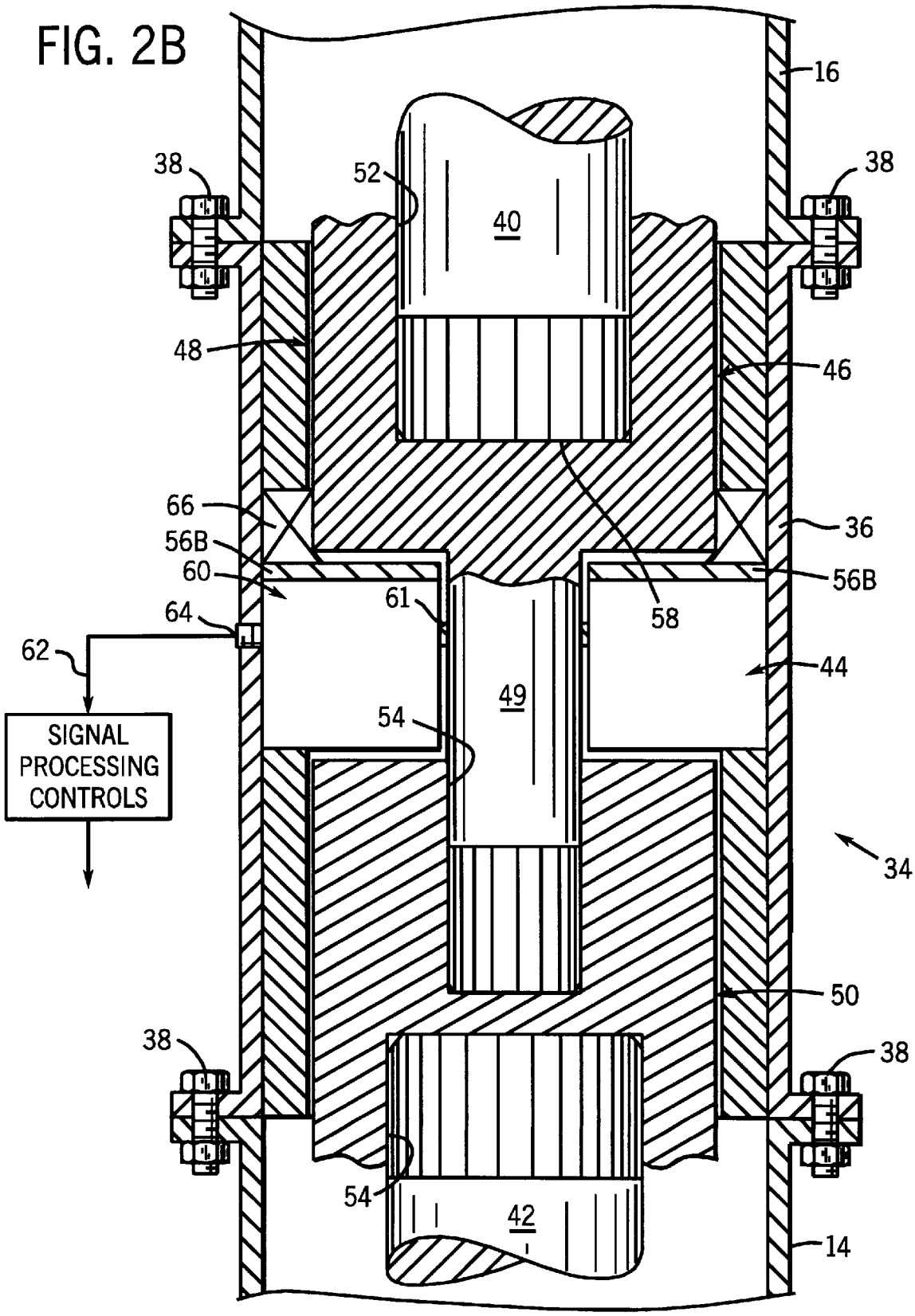
FIG. 2B illustrates a sensor assembly, according to another alternate embodiment of the present invention, positioned between components of the submergible pumping system.

Alternatively, a pressure transducer could be located between coupling measurement unit 48 or thrust bearing 66 and stationary sensor pickup assembly 60. For example, as illustrated in FIG. 2B, a sensor 56B is disposed between sensor pickup assembly 60 and thrust bearing 66. The thrust bearing 66 is not bound axially to outer housing segment 36, thus permitting transfer of the downthrust acting on shaft 40 to sensor 56. In this embodiment, the sensor signal can be transferred through opening 64 without requiring transfer of the signal from coupling shaft 49 to sensor pickup assembly 60.

Figure 3:
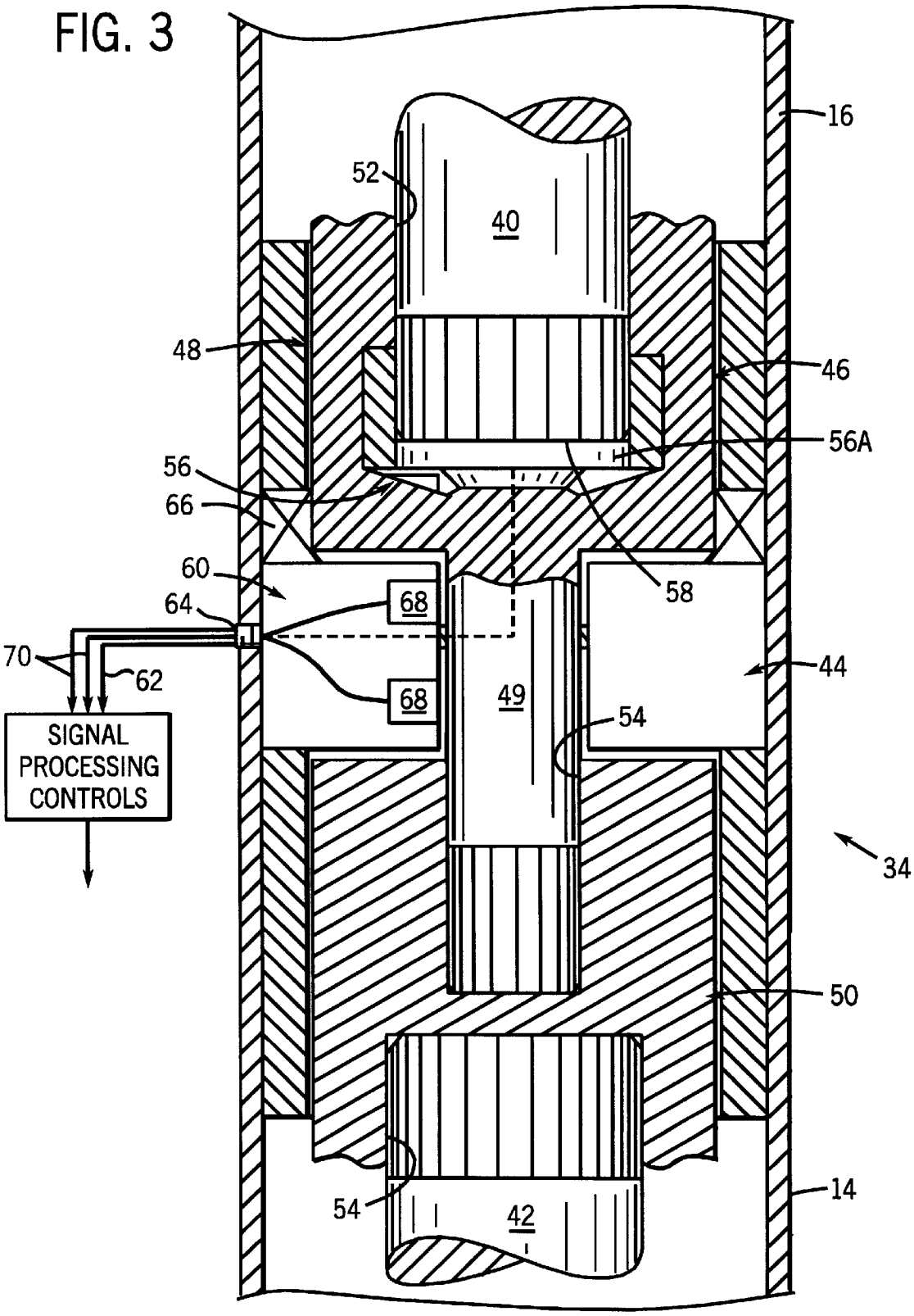
FIG. 3 illustrates an alternate embodiment of the sensor assembly shown in FIG. 2.

With reference to FIG. 3, alternate or additional sensors for testing other parameters of submergible pumping system 10 may be incorporated into parameter measuring system 34. For example, an additional sensor or sensors 68 may be mounted to pickup assembly 60 and connected via leads 70 that extend through outer housing segment 36 at opening 64. The particular type of sensor 68 will vary depending on the variable condition or parameter being measured. Because sensor 68 may be mounted adjacent shaft portion 49, parameters such as operating RPM and viscosity, can be measured without difficulty. Other additional sensors can be used to measure parameters, such as fluid temperature, fluid density, pump intake pressure and oil dielectric.

For example, a variety of probes are available that detect changing dielectric permittivity, allowing monitoring of the oil dielectric in the motor protector 14. By monitoring oil dielectric in the motor protector, contamination of the motor oil due to the motor protector losing pressure or leaking can be detected. This will help the operator prevent damage to the relatively expensive submergible motor 12 by repairing the system before motor damage ensues. Another exemplary sensor that could be incorporated into parameter measuring system 34 is an accelerometer, such as a tri-axial accelerometer, that can be used to determine degree of vibration in submergible pumping system 10. Also, the pressure sensing system can be used at a particular location to provide real time vibration measurements.

Figure 4:
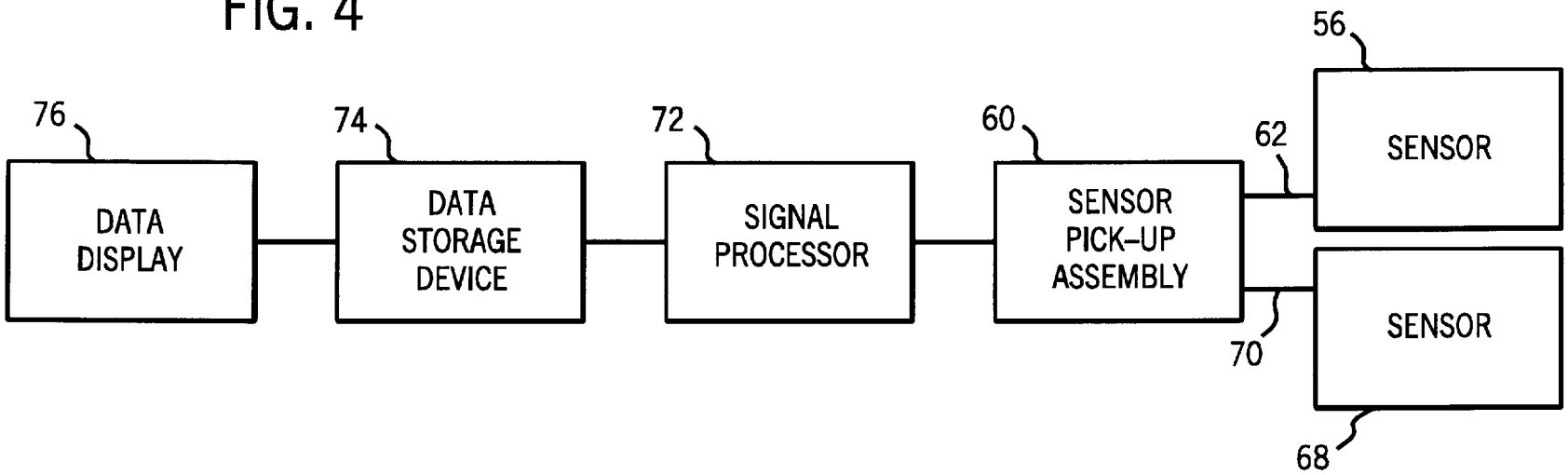
FIG. 4 is a block diagram illustrating the processing of control signals from the sensor assembly.

As illustrated in the block diagram of FIG. 4, sensors 56 and/or 68 generate signals corresponding to the parameter level or degree of the parameter being measured. The signals are transferred to sensor pick up assembly 60 and then sent to a signal processor 72. Signal processor 72 converts the signals into a desired format including, for instance, converting any analog signals into appropriate digital signals. The converted signals are then transferred to a data storage device 74 and data display 76.

The signal processor 72 and data storage device 74 can be located with submergible pumping system 10 at a downhole location for retrieval at appropriate intervals to monitor the downhole submergible pump performance. In this case, the data storage device 74 can be retrieved and connected to data display 76 for review of the accumulated data. However, it is generally preferred that the data generated by sensors 56 and/or 68 be available on a real time basis. Thus, the output signals are transferred continuously to data display 76 at the earth's surface. In this situation, data storage device 74 and data display 76 could be combined, for example, in a data receiving station, such as a personal computer available to an operator working at the earth's surface.

The signals can be transmitted from a downhole location to the earth's surface by a variety of methods, including the use of a conductor or optical fiber running between the parameter sensing system 34 and the data receiving station. Often such signal transfer lines are attached to or combined with a conventional power cable used to supply power to submergible motor 12. Alternatively, the signals could be transmitted via RF transmission or they could be transmitted directly via the power cable. In the latter case, the signals are multiplexed on the power cable and transmitted over the same conductors supplying power to submergible motor 12.

Regardless of the specific sensors or signal transmission methods used, the present inventive system provides a method for sensing a given parameter within a submergible component or components of a submergible pumping system of the type utilized in pumping production fluids from a wellbore. With the present system, a string of submergible components, e.g., submergible motor 12, motor protector 14 and submergible pump 16, can be assembled with an integral sensor assembly affixed between two of the submergible components. Because the sensor assembly is integral with the string of submergible components, it can be deployed and removed simultaneously with the rest of the submergible pumping system. The present inventive system facilitates detection of a predetermined parameter related to at least one of the submergible components, and is particularly adapted to measuring the downthrust created by a submergible pump. The sensor assembly also is able to provide an output signal, indicative of the predetermined parameter, to a data receiving station, such as the combined data storage device 74 and data display 76.

It will be understood that the foregoing description is of preferred embodiments of this invention, and that the invention is not limited to the specific form shown. For example, a variety of sensors may be utilized; different signal processing hardware and software could be incorporated into the system; the sensor assembly can be located between a variety of submergible components within a submergible pumping system; and different styles of coupling assemblies can be used for transferring rotation from one internal shaft to another. These and other modifications may be made in the design and arrangement of the elements without departing from the scope of the invention as expressed in the appended claims.

What is claimed is:

1. A system for measuring an operating parameter related to a submergible pumping system in a downhole, wellbore environment, comprising:

a first system component having a first rotatable shaft;

a second system component having a second rotatable shaft;

a coupling assembly connected between the first rotatable shaft and the second rotatable shaft such that the coupling assembly transfers rotation from the first rotatable shaft to the second rotatable shaft; and a sensor assembly positioned along the coupling assembly, the sensor assembly including a sensor to detect axial loading of the first rotatable shaft and to provide an output signal corresponding to the axial loading.

2. The device as recited in claim 1, further comprising a signal processor connected to the sensor and a display device connected to the signal processor to convert the output signal and to display it as a given parameter level related to a performance parameter of the submergible pumping system.

3. The device as recited in claim 2, wherein the first system component comprises a submergible pump.

4. The device as recited in claim 3, wherein the performance parameter is flow rate of the submergible pump.

5. The device as recited in claim 1, wherein the sensor comprises a pressure transducer.

6. The device as recited in claim 3, wherein the second system component comprises a motor protector.

7. The device as recited in claim 1, further comprising a housing rigidly connected between the first system component and the second system component.

8. The device as recited in claim 7, wherein the housing includes an aperture through which at least one lead line may pass to an interior region of the housing.

9. The device as recited in claim 1, wherein the sensor assembly includes an additional sensor adapted to sense a variable condition.

10. The device as recited in claim 9, wherein the variable condition is shaft RPM.

11. A submergible pumping system having an integral sensor assembly for use in pumping production fluids from a wellbore, comprising:

a plurality of submergible pumping system components, including:

a submergible motor;

a motor protector; and a submergible pump; and a sensor assembly affixed intermediate two components of the plurality of submergible pumping system components, the sensor assembly having a sensor adapted to detect variation in a parameter internal to at least one of the plurality of submergible pumping system components.

12. The submergible pumping system as recited in claim 11, wherein the submergible pump includes a rotatable shaft and the sensor is configured to detect axial loading of the shaft.

13. The submergible pumping system as recited in claim 12, wherein the sensor assembly is disposed between the submergible pump and the motor protector.

14. The submergible pumping system as recited in claim 12, further comprising a coupling assembly connected to a rotatable shaft of the submergible pump.

15. The submergible pumping system as recited in claim 14, wherein the coupling assembly is connected between the rotatable shaft of the submergible pump and a motor protector shaft of the motor protector.

16. A method for sensing a given parameter within a submergible component of a submergible pumping system utilized in pumping production fluids from a wellbore, comprising:

assembling a string of submergible components, including a submergible motor and a submergible pump;

locating an integral sensor assembly between a first submergible component and a second submergible component of the string of submergible components;

detecting a predetermined parameter related to at least one of the string of submergible components; and providing an output signal, indicative of the predetermined parameter, to a data station.

17. The method as recited in claim 16, further comprising connecting a coupling mechanism between a first drive shaft of the first component and a second drive shaft of the second component; wherein the step of detecting comprises detecting axial loading of the first drive shaft.

18. The method as recited in claim 16, wherein the step of detecting comprises detecting downthrust of a drive shaft in the submergible pump and the step of providing comprises providing the output signal to represent the degree of downthrust.

19. The method as recited in claim 18, further comprising correlating the output signal to a submergible pump flow rate at the data station.

20. The method as recited in claim 16, further comprising the steps of assembling a motor protector within the string of submergible components and affixing the integral sensor assembly between the submergible pump and the motor protector.

21. The method as recited in claim 16, further comprising detecting a second predetermined parameter.

22. The method as recited in claim 16, further comprising locating a second integral sensor assembly between a predetermined pair of submergible components.

* * * * *